US007207508B1

(12) United States Patent
Golshevsky

(10) Patent No.: US 7,207,508 B1
(45) Date of Patent: Apr. 24, 2007

(54) WEDDING GLASS HOUSING

(76) Inventor: Ephraim Golshevsky, 7 torat Hessed Street, Jerusalem (IL) 94464

( * ) Notice: Subject to any disclaimer, the term of this patent is extended or adjusted under 35 U.S.C. 154(b) by 321 days.

(21) Appl. No.: 10/455,317

(22) Filed: Jun. 6, 2003

(51) Int. Cl.
*B02C 23/04* (2006.01)
*B65D 85/44* (2006.01)

(52) U.S. Cl. ..... 241/37.5; 241/99; 241/101.2; 206/426; 206/486; 206/523; 206/592

(58) Field of Classification Search ..... 206/426, 206/486, 490, 523, 592; 241/30, 37.5, 99, 241/101.2
See application file for complete search history.

(56) References Cited

U.S. PATENT DOCUMENTS 2,811,246 A * 10/1957 Sloane ..... 206/584
4,852,743 A * 8/1989 Ridgeway ..... 206/583
4,869,369 A * 9/1989 Turngren ..... 206/523
5,346,122 A * 9/1994 Leader et al. ..... 229/162.1
5,484,063 A * 1/1996 Cuccio et al. ..... 206/722
2001/0030141 A1* 10/2001 Kasakura ..... 206/592

* cited by examiner

*Primary Examiner*—Lowell A. Larson
*Assistant Examiner*—Jason Y. Pahng
(74) *Attorney, Agent, or Firm*—Baker Botts L.L.P.

(57) ABSTRACT

The invention provides a method for effecting a controlled breaking of a wedding glass, comprising providing a device having a housing having a bottom and top sheet both of puncture-resistant material and an intermediate layer of compressible material retained between the sheets, the intermediate layer being provided with an opening forming a well sized to accommodate a wedding glass therein, whereby a stamping action directed to the top sheet results in the compression of the intermediate layer and the shattering of the glass within the confines of the sheets and the well.

8 Claims, 2 Drawing Sheets

WEDDING GLASS HOUSING

The present invention relates to a method for producing a wedding momento and a device in the form of a crushable container holding a frangible drinking glass to serve this purpose.

In traditional Jewish weddings there exists a religious custom of breaking a glass by stamping thereon during the matrimonial ceremony, to give expression to sorrow of the destruction of the Temple in Jerusalem. To prevent possible injury during breaking and the uncontrolled dispersal of sharp glass shards thereafter, the glass is usually pre-wrapped with cloth or metal foil before being stamped upon and broken during the ceremony. On conclusion of the ceremony the package is disposed of to prevent possible injury to children playing therewith.

In general, people around the world attempt to collect items related to religious and other ceremonies in order to have lasting memories of an event of which they were a part. More specifically, weddings clearly constitute a major significant event in life, and numerous items, not necessarily religious-associated items, are collected and serve as memorabilia. For example, a couple might save remaining wedding invitations and place such invitation in their wedding photo album. In the case of religious-associated items there is much significance in preserving such item which may be handed down to future generations.

It is therefore one of the objects of the present invention to obviate the disadvantages of prior art wedding glasses and to provide a device which retains the glass shards in a safer manner.

It is a further object of the present invention to provide an item which can be readily marketed to wedding halls and souvenir shops.

Yet a further object of the invention is to provide a souvenir item which can be retained as is and placed on a display shelf or hung on a wall.

Still a further object of the invention is to safely retain the broken glass in a removable manner for use thereof in the making of an unrelated decorative article to serve as a momento.

The present invention achieves the above objects by providing a method for effecting a controlled breaking of a wedding glass, comprising providing a device having a housing having a bottom and top sheet both of puncture-resistant material and an intermediate layer of compressible material retained between said sheets, said intermediate layer being provided with an opening forming a well sized to accommodate a wedding glass therein, whereby a stamping action directed to said top sheet results in the compression of said intermediate layer and the shattering of said glass within the confines of said sheets and said well.

In a preferred embodiment of the present invention there is provided a device for the controlled breaking of a wedding glass, comprising a housing having a bottom and top sheet both of puncture-resistant material and an intermediate layer of compressible material retained between said sheets, said intermediate layer being provided with an opening forming a well sized to accommodate a wedding glass therein, whereby a stamping action directed to said top sheet results in the compression of said intermediate layer and the shattering of said glass within the confines of said sheets and said well.

In a most preferred embodiment of the present invention there is provided device for the controlled breaking of a wedding glass wherein said top sheet can be readily separated from said intermediate layer to allow convenient insertion of said glass before use and removal of fragments after use.

In another aspect of the invention the device for the controlled breaking of a wedding glass has a top sheet which is transparent in the area corresponding to the well area and is opaque over its remaining surface.

Yet further embodiments of the invention will be described hereinafter.

No relevant disclosure was found in a search of U.S. patents.

It will thus be realized that the novel device of the present invention serves to enclose the sharp glass fragments resulting from breakage in a completely safe manner, eliminating any danger of injury either to the bridegroom, who customarily breaks the glass, or to other persons in the vicinity, or to children playing therewith.

The wedding momento can be formed in either of two ways. The device retaining the broken glass having a non-broken transparent top cover can be used as is and hung on a wall of the home. Alternatively, the glass shards can be removed, even if the top cover of the device is damaged, and processed for use in the decoration of a long-lasting display item such as for example, a ceramic housing for a mezuzah.

The marketing advantage of the device according to the present invention is self-evident, as text can readily be added to the upper sheet to advertise the wedding hall selling the device or providing the device free as a patronage inducement. The text can be personalized for the couple by additional wording such as the date of the wedding, the officiating rabbi and the names of the couple being married.

Regarding couples uninterested in retaining the remnants of the wedding glass, the device of the present invention yet serves as a safe and convenient means of disposal.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
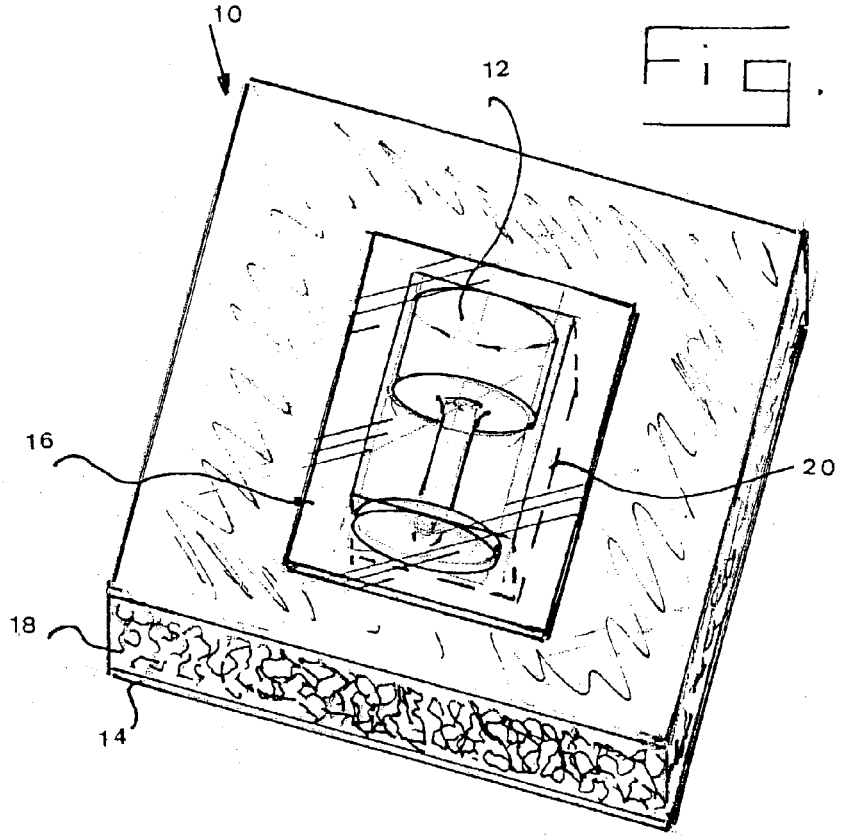
FIG. 1 is a perspective view of a preferred embodiment of the device according to the invention.

There is seen in FIG. 1 a device 10 for the controlled breaking of a wedding glass 12.

A housing is formed having a bottom sheet 14, and a top sheet 16, both of puncture-resistant material.

An intermediate layer 18 of compressible material, for example polyurethane foam, separates the sheets 14, 16. The intermediate layer 18 may suitably be permanently attached to the bottom sheet 14 by use of adhesives, adhesive tape, mechanical means or by any appropriate welding technology.

The top sheet 16 is typically transparent, at least in part, and is preferably attached by mechanical means, for example by insertion of the top sheet into a peripheral rectangular groove (not seen) molded into the upper face of the intermediate layer 18. The top sheet 16 is suitably made of a transparent puncture-resistant and crack-resistant material, for example a polycarbonate resin. Adhesive attachment of the top sheet to the intermediate layer is feasible, provided the adhesive is evenly applied in a thin film along the periphery of the sheet, preferably using a transparent adhesive, so as to maintain the attractive appearance of the device.

The intermediate layer 18 is provided with an opening forming a well 20 sized to accommodate a frangible wedding glass 12 therein.

When a stamping action is directed to the top sheet 16, there results compression of the intermediate layer 18 and the shattering of the glass 12. The resulting fragments are safely confined in the well 20 by means of the top and bottom sheets 14, 16.

With regard to the rest of the figures, similar reference numerals have been used to identify similar parts.

Figure 2:
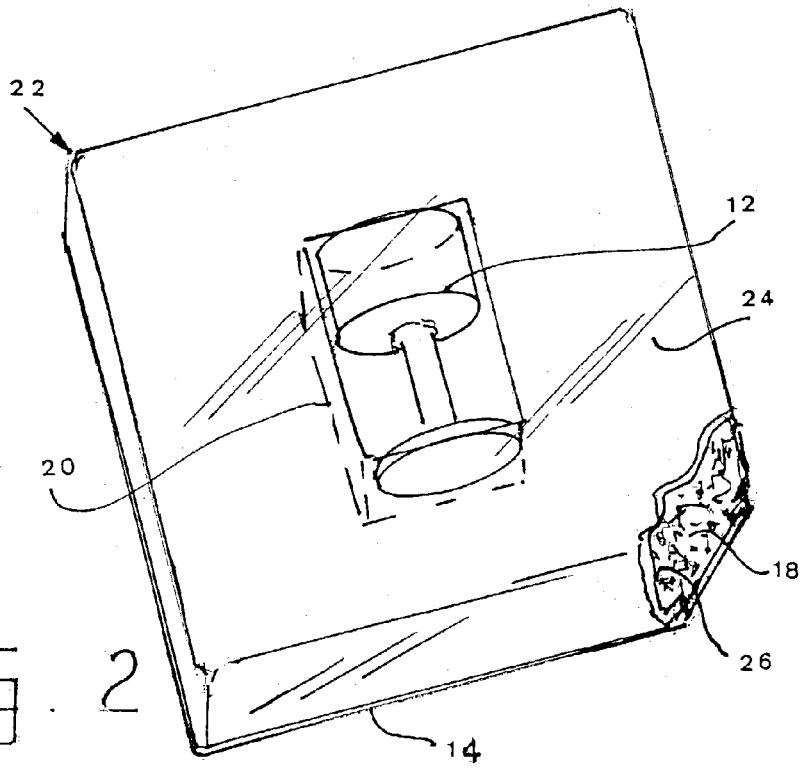
FIG. 2 is a perspective fragmented view of an embodiment having an extended top sheet.

Referring now to FIG. 2, there is seen a further embodiment of the device 22 for the controlled breaking of a wedding glass 12.

The top sheet 24 is made of a flexible material and extends over the edges 26 of the intermediate layer 18 and is attached to the bottom sheet 14. Thereby appearance is improved because the edges 26 of the crushable material representing the intermediate layer 18 are covered. Furthermore, additional space is made available on the top sheet 24 for adding any desired text or picture.

Figure 3:
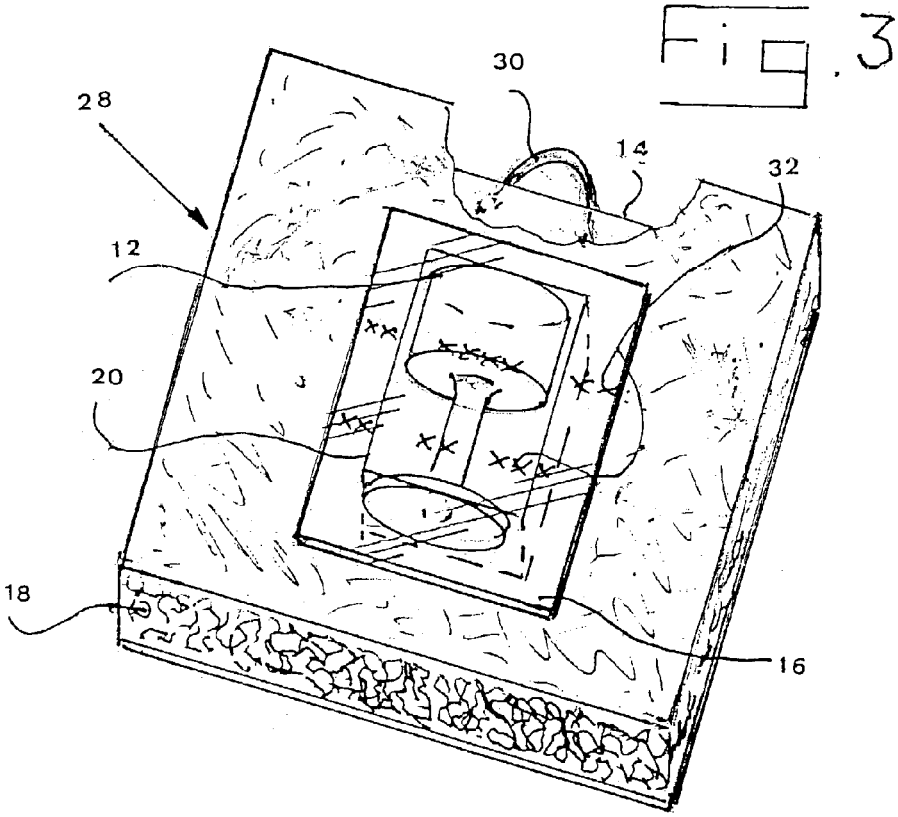
FIG. 3 is a perspective fragmented view of an embodiment intended for wall hanging.

FIG. 3 illustrates an embodiment of the device 28 further provided on it's bottom face 14 with a loop 30 for wall hanging.

To enhance the value of the device as a momento, any desired text 32 can be printed onto the upper sheet (e.g. "Let's always remember our happiest moments!" Or "Danny and Chani, 21 May 2003, Super Wedding Hall")

Figure 4:
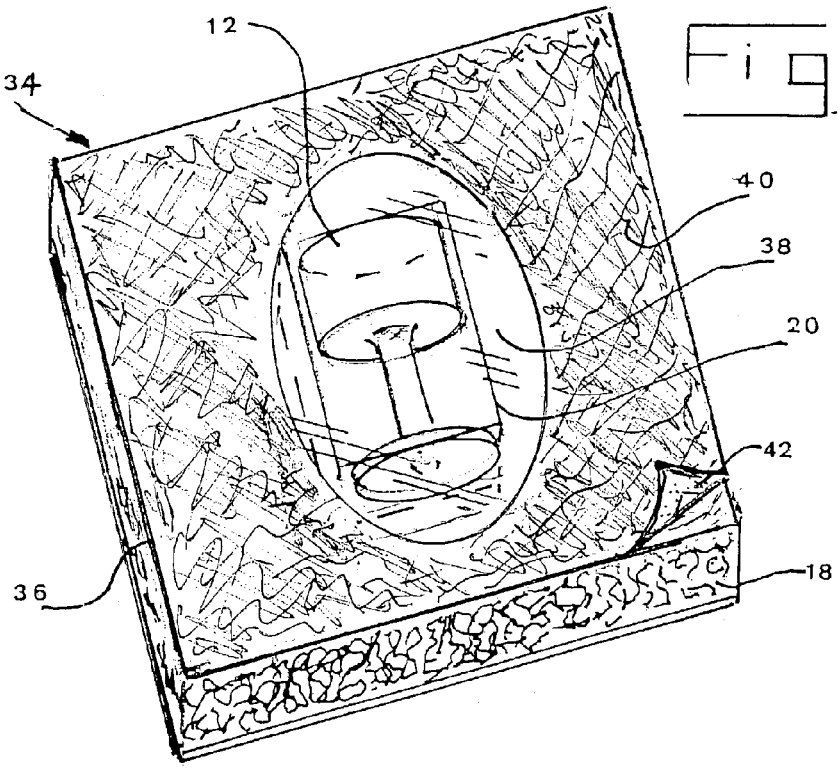
FIG. 4 is a perspective view of an embodiment configured to allow display and to allow ready access to the well.

Seen in FIG. 4 is a further embodiment of the device 34 wherein the top sheet 36 is transparent in the area 38 corresponding to the well 20 area and is opaque over its remaining area 40.

A coat of peelable adhesive 42 or double sided adhesive tape is applied under the opaque area 40 of the top sheet 36 for attachment thereof to the intermediate layer 18.

In the illustrated embodiment the top sheet 36 can be readily separated from the intermediate layer 18. Thus there is provided means to allow convenient insertion of the wedding glass 12 before use, and removal of fragments thereof, if desired for reprocessing, after use.

The present invention also provides for a method for effecting a controlled breaking of a wedding glass 12, comprising the steps:

a) Providing a device 10 having a housing having a bottom and top sheet 14, 16 both of puncture-resistant material. The top sheet 16 is preferably transparent while the bottom sheet 14 of the puncture-resistant material is rigid.

Preferably the intermediate layer 18 of compressible material is made of a sponge-like material. The layer 18 is retained between the sheets 14, 16, the intermediate layer being provided with an opening forming a well 20. Imprinting the top sheet with any desired text (e.g. "We'll stay together—always!") or picture of a general nature.

b) Attachment of one sheet 14 or 16 to the intermediate layer 18.

c) Insertion of a wedding glass 12 into the well 20.

d) Attachment of the second sheet 14 or 16 to the intermediate layer 18.

An optional additional step at the point of sale to the couple to be married e) Adding personalized text directly to the top sheet 16 or by means of a stick-on label, for example "Moty and Adina, 27 Mar. 2001, Diamond Hotel, Pearl Beach".

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A compressible container device for the controlled breaking of a frangible wedding glass, comprising a compressible housing having a bottom and top sheet both of puncture-resistant material and an intermediate layer of compressible material retained between said sheets, said intermediate layer being provided with an opening forming a well accommodating said wedding glass therein, wherein said compressible material is a sponge-like crushable material adapted to facilitate the shattering of said frangible wedding glass disposed in said well, whereby a stamping action directed to said top sheet results in the compression of said intermediate layer and the compression of said compressible container and the shattering of said glass within the confines of said sheets and said well.

2. The device according to claim 1 for the controlled breaking of a wedding glass wherein said top sheet extends over the edges of said intermediate layer and is attached to said bottom sheet.

3. The device according to claim 1 for the controlled breaking of a wedding glass wherein said intermediate layer is adhesively attached to at least said bottom sheet.

4. The device according to claim 1 for the controlled breaking of a wedding glass further provided on its bottom face with means for wall hanging.

5. The device according to claim 1 for the controlled breaking of a wedding glass wherein said top sheet is made of a transparent puncture-resistant and crack-resistant material.

6. The device according to claim 1 for the controlled breaking of a wedding glass wherein said top sheet is transparent in the area corresponding to the well area and is opaque over its remaining surface.

7. The device according to claim 1 for the controlled breaking of a wedding glass wherein said top sheet is readily separable from said intermediate layer to allow convenient insertion of said glass before use and removal of fragments after use.

8. A compressible container device for the controlled breaking of a frangible wedding glass, comprising a compressible housing having a bottom and top sheet both of puncture-resistant material and an intermediate layer of compressible material retained between said sheets, said intermediate layer being provided with an opening forming a well accommodating said wedding glass therein, whereby a stamping action directed to said top sheet results in the compression of said intermediate layer and the shattering of said glass and the retention of said shattered glass between said sheets and within said well, wherein said top sheet and said compressible material are structured to transmit a force generated by said stamping action through said top sheet and said compressible material to said frangible wedding glass.

* * * * *